US008904670B2

(12) United States Patent
Son et al.

(10) Patent No.: US 8,904,670 B2
(45) Date of Patent: Dec. 9, 2014

(54) DRYER

(75) Inventors: Chang Woo Son, Changwon-si (KR); Sang Hun Bae, Changwon-si (KR); Seon Il Heo, Changwon-si (KR); Yeon Sik Choi, Changwon-si (KR); Sang Jin Kim, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 729 days.

(21) Appl. No.: 12/314,779

(22) Filed: Dec. 16, 2008

(65) Prior Publication Data

US 2009/0172967 A1 Jul. 9, 2009

(30) Foreign Application Priority Data

Jan. 3, 2008 (KR) ..... 10-2008-0000783

(51) Int. Cl.
*F26B 19/00* (2006.01)
*D06F 58/20* (2006.01)
*D06F 58/28* (2006.01)

(52) U.S. Cl.
CPC ..... *D06F 58/203* (2013.01); *D06F 58/28* (2013.01); *D06F 2058/2803* (2013.01)
USPC ..... 34/527; 34/562; 34/60; 34/90

(58) Field of Classification Search
USPC ..... 34/526, 527, 542, 562, 60, 90, 597; 68/5 R, 5 C
See application file for complete search history.

(56) References Cited

U.S. PATENT DOCUMENTS

| | | | | | |
|---|---|---|---|---|---|
| 3,712,086 | A * | 1/1973 | Payet et al. | ..... | 68/5 C |
| 4,372,054 | A * | 2/1983 | Pomerantz et al. | ..... | 34/526 |
| 6,088,932 | A * | 7/2000 | Adamski et al. | ..... | 34/274 |
| 2006/0053651 | A1 * | 3/2006 | Tadano et al. | ..... | 34/74 |
| 2008/0148596 | A1 * | 6/2008 | Son et al. | ..... | 34/486 |
| 2008/0276382 | A1 * | 11/2008 | Benne et al. | ..... | 8/158 |

FOREIGN PATENT DOCUMENTS

| | | | |
|---|---|---|---|
| DE | 197 04 417 | A1 | 8/1998 |
| DE | 10 2004 039 435 | A1 | 2/2006 |
| EP | 1 852 541 | A1 | 11/2007 |
| EP | 1852542 | A1 * | 11/2007 |
| KR | 10-0664289 | | 12/2006 |
| KR | 10-0813050 | | 3/2008 |
| KR | 10-2008-0058590 | | 6/2008 |

* cited by examiner

*Primary Examiner* — Jiping Lu
(74) *Attorney, Agent, or Firm* — McKenna Long & Aldridge LLP

(57) ABSTRACT

A laundry machine, particularly, a dryer using steam is disclosed. The laundry machine such as a washing machine, a dryer, a drying and washing machine is an apparatus which washes or dries articles such as clothes. The dryer includes a drum adapted to accommodate articles to be dried, a control panel adapted to provide an interface with a user, and a controller, wherein the control panel includes a course selection part which allows a user to select a specific course as an operation course during a steam course, which includes a steam process for supplying steam into a drum, such that the dried articles have a moisture content equal to or larger than 6%, and the controller controls an operation of the dryer to perform the selected operation course.

10 Claims, 7 Drawing Sheets

DRYER

CROSS-REFERENCE TO RELATED APPLICATION

This application claims the benefit of Korean Patent Application No. 10-2008-0000783, filed on Jan. 3, 2008, which is hereby incorporated by reference in its entirety as if fully set forth herein.

BACKGROUND OF THE INVENTION

1. Field of the Invention

The present invention relates to a laundry machine, and more particularly to a dryer using steam.

2. Discussion of the Related Art

A laundry machine is an apparatus which washes or dries articles such as clothes. Laundry machines include a washing machine, a dryer, a drying and washing machine, and the like.

Also, the dryer includes a drum type dryer, a cabinet type dryer and a cabinet type refresher. The cabinet type machines include a laundry accommodating porting inside the cabinet. Therefore, the drum in the drum type dryer could be said as a laundry accommodating portion.

Recently, a steam generator is added to the washing machine, particularly, a drum washing machine to supply steam to the laundry, thereby improving washability and reducing energy consumption.

Meanwhile, as the quality of life is improved, a dryer for artificially drying the washed laundry instead of natural drying has been widely used.

However, since a conventional dryer is an apparatus for simply drying the articles, the dryer is required to perform additional functions in addition to drying of clothes. As for the reason, since the articles have wrinkles after the drying operation is completed, additional ironing is necessary.

Further, although the articles are not contaminated to a level required for washing, it is necessary to remove the odor and wrinkles from the articles.

Meanwhile, when the dryer performs additional functions, it is necessary for the user to easily use functions. As for the reason, even though the functions offer excellent effects and performance, if the user cannot easily use the functions, the user will use only a conventional drying function.

The dryer generally includes a control panel for providing an interface with the user. The user inputs various types of information to the dryer and obtains the information through the control panel.

Accordingly, it is necessary for the user to easily select the drying function and additional functions through the control panel. Further, even when the drying function and additional functions are related to each other, it is necessary for the user to easily use the dryer without confusion.

Further, it is necessary to control the operation of the dryer such that additional functions can be performed under optimum conditions, which may influence the reduction of energy consumption.

SUMMARY OF THE INVENTION

Accordingly, the present invention is directed to a dryer that substantially obviates one or more problems due to limitations and disadvantages of the related art.

An object of the present invention is to provide a dryer having additional functions in addition to a drying function included in a conventional dryer, thereby improving convenience in use.

Specifically, another object of the present invention is to provide a dryer having a crease removal function, a static electricity removal function, or an easy ironing function, thereby improving convenience in use.

Further, another object of the present invention is to provide a dryer capable of efficiently removing the odor and efficiently preventing a recurrence of the odor even though the laundry is left in the dryer for a specific period of time after the odor is removed.

Further, a further object of the present invention is to provide a convenient dryer which enables a user to easily select a drying function and additional functions.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dryer comprises a drum adapted to accommodate articles to be dried, a control panel adapted to provide an interface with a user, and a controller, wherein the control panel includes a course selection part which allows a user to select a specific course as an operation course during a steam course, which includes a steam process for supplying steam into a drum, such that the dried articles have a moisture content equal to or larger than 6%, and the controller controls an operation of the dryer to perform the selected operation course.

In this case, the control panel may include an option selection part which allows the user to additionally select an option course including the steam process in the operation course.

That is, if the steam course is selected, the steam process is performed even though the option course is not selected. The steam course may include various courses according to functions and effects of the present course.

Further, if a steam-available course is selected and the option course is not selected, only the steam-available course is performed without the steam process. The steam-available course may include various courses according to functions and effects of the present course. For example, the steam-available course may include various courses for drying clothes having a low possibility of heat damage.

Further, if the steam-available course is selected and the option course is selected, the steam-available course and the option course may be performed. Further, if a steam-free course is selected, the steam-free course is performed regardless of selection of the option course, and the steam process is not performed. The steam-free course may include various courses for drying clothes having a possibility of heat damage.

Thus, the dryer according to the present invention can perform various additional functions using steam. The additional functions may be performed by selecting only the operation course or by selecting both the operation course and the option course.

The steam-available course may include a drying process in which hot air is supplied into the drum to dry the articles, and a cooling process in which cool air is supplied into the drum to cool the articles.

In this case, if the steam-available course is selected and the option course is selected, the controller controls the dryer such that the option course is performed during the drying process or the cooling process. Further, if the steam-available course is selected and the option course is selected, the controller controls the dryer such that the option course is performed after the steam-available course is completed.

Meanwhile, the option selection part may include a plurality of option courses according to the functions and purposes obtained by using steam. Only one of the plural option courses may be selected. For example, the option selection part may include a button selected to perform the option course during the steam-available course and a button selected to perform the steam process after the steam-available course is finished.

In the steam-available course, the operation may be controlled such that operation conditions of the drying process are changed according to the dryness detected during the drying process. In this case, the operation conditions may include at least one of the drying process time, the temperature in the drum, and the capacity of the heater for heating air supplied into the drum.

For example, the operation conditions may include a time required for the drying process. That is, as the articles are dried, if the dryness is higher than expected, the time required for the drying process is reduced, and if the dryness is lower than expected, the time required for the drying process is extended. Accordingly, since the optimum drying process can be performed, it is possible to prevent damage of the articles due to excessive drying or dissatisfaction of the consumer due to insufficient drying.

In this case, it is possible to determine the amount of the articles to be dried (laundry amount) using the dryness detected during the drying process. As for the reason, if the laundry amount is large, the dryness would be lower than expected, and the time required for the drying process would increase. Further, if the laundry amount is small, the dryness would be higher than expected, and the time required for the drying process would decrease. That is, the dryness detected as the drying process is performed would vary according to the laundry amount. It is possible to determine the laundry amount through the dryness.

Meanwhile, it is preferable that the heater for generating steam is operated at different time points according to the determined amount of the articles. For example, the drying process is completed at different time points according to the laundry amount, and the heater is operated at different time points according to the time point at which the drying process is completed. Further, it is preferable that the heater operation time varies according to the determined amount of the articles. In this case, the heater operation time is related to the amount of steam supplied into the drum. That is, as the heater operation time increases, the steam process time increases and the amount of supplied steam increases.

The steam course may include the drying process in which hot air is supplied into the drum to dry the articles and the steam process. In the steam course, the operation may be controlled without varying the preset operation conditions of the drying process during the drying process. As for the reason, the steam course may be performed on the articles such as dry clothes or may be performed such that the articles have a certain moisture content when the course is completed. In this case, it is unnecessary or waste of energy to dry the clothes to the optimum dryness through the drying process.

Meanwhile, if the steam course is selected, preferably, the option course is inactivated not to be selected. That is, if the user selects the option course, it is possible to inform the user that the option course cannot be selected though the sound. Further, it is possible to visually inform the user that the option course cannot be selected by turning the LED off. Of course, if the above-mentioned steam-available course is selected, it is possible to inform the user that the option course can be selected by turning the LED on.

Meanwhile, the steam course may include a course in which the steam process is performed such that the articles have a moisture content of 5% to 6% after the drying process is completed. That is, when the present steam course is completed, the steam course is performed such that the articles have a moisture content of 5% to 6%. The moisture content makes the articles uniformly damp and allows the user to easily iron the articles. Accordingly, the user can easily iron the articles through the present course. The course is simply referred to as an easy ironing course.

Further, the steam course may include a course in which the drying process is performed after the steam process performed on dry articles is completed. In this case, the dry articles mean clothes which have not been washed, or articles which are not contaminated, but required to remove the odor or wrinkles. Further, the dry articles mean articles which are left in the drum for a long time after the drying process is completed and required to remove the odor or wrinkles again. Accordingly, the user can easily remove the odor or wrinkles from the clothes without washing the clothes. The course is simply referred to as a steam fresh course or a refresh course.

In order to achieve the above-mentioned objects, the dryer comprises a drum adapted to accommodate articles to be dried, a control panel adapted to provide an interface with a user, and a controller, wherein the control panel includes a course selection part which allows a user to select a specific course as an operation course during a steam course, which includes a steam process for supplying steam into a drum, such that the dried articles have a moisture content equal to or larger than 6%, and the controller controls an operation of the dryer to perform the selected operation course. In this case, the specific course is a steam course for efficiently removing the odor of the dry articles and efficiently preventing the recurrence of the odor.

Further, preferably, the controller controls the operation to perform the steam process such that the moisture content is equal to or larger than 11% in the specific course. Further, the specific course includes a drying process in which hot air is supplied into the drum to dry the articles; and a cooling process in which cool air is supplied into the drum to cool the articles. The steam process, the drying process and the cooling process are sequentially performed in the specific course.

In this case, a total operation time of the specific course may be preset regardless of an amount of the articles to be dried accommodated in the drum. Further, operation times of sub-processes included in the specific course may be preset regardless of the amount of the articles to be dried accommodated in the drum.

Further, fine water particles and hot air instead of the steam may be supplied into the drum in the steam process. Further, in the steam process, a specific amount of steam may be supplied into the drum regardless of an amount of the articles to be dried accommodated in the drum. In this case, preferably, the specific amount of steam is a moisture content of 6% or more on the basis of a maximum amount of articles accommodated in the dryer.

Meanwhile, if the steam-free course is selected, preferably, the option course is inactivated not to be selected. As for the reason, the steam-free course is provided for the articles having a possibility of heat damage due to the steam process. Accordingly, it is possible to prevent damage due to the user's error.

According to the dryer of the present invention, the amount of steam supplied to the articles in the steam process can be controlled to vary according to the amount of the articles. Of course, only the preset amount of steam may be supplied to the articles regardless of the amount of the articles. However, if the amount of the articles becomes larger such that the articles can have an optimum moisture content according to the function, it is preferable to increase the amount of steam.

Thus, the control panel may include a button which allows the user to select the amount of steam supplied to the articles in the steam process, or a button which allows the user to input the amount of the articles.

Meanwhile, in the steam process of the above-described dryer, the steam is supplied into the drum, but it is not limited thereto. That is, fine water particles and hot air instead of the steam may be supplied into the drum in the steam process.

According to the present invention, there is provided a dryer having additional functions in addition to a drying function included in a conventional dryer, thereby improving convenience in use.

Further, according to the present invention, there is provided a dryer having a crease removal function, a static electricity removal function, or an easy ironing function, thereby improving convenience in use.

Further, according to the present invention, there is provided a dryer capable of efficiently removing the odor and efficiently preventing a recurrence of the odor even though the laundry is left in the dryer for a specific period of time after the odor is removed. Further, the additional functions can be efficiently performed for a short period of time, thereby improving satisfaction of the user.

Further, according to the present invention, there is provided a convenient dryer which enables a user to easily select a drying function and additional functions.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
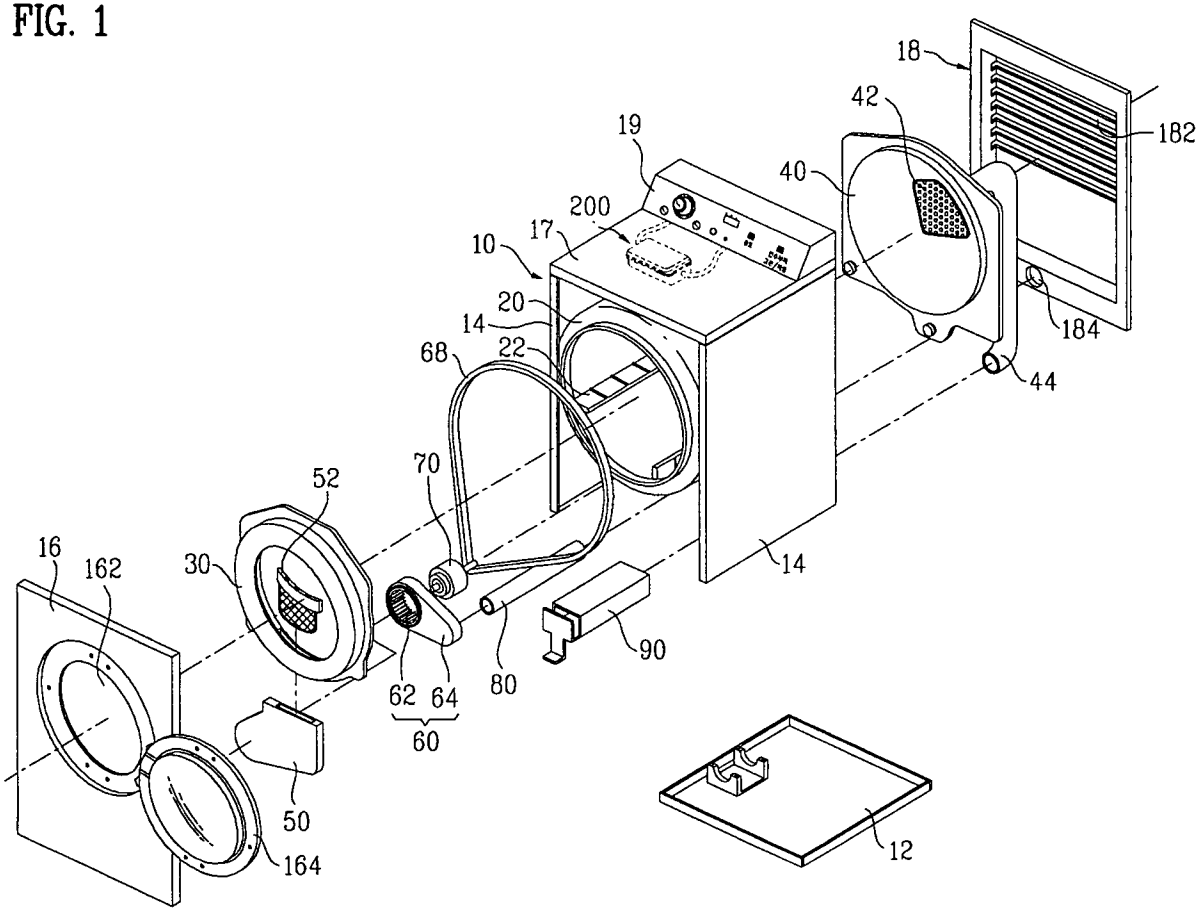
FIG. 1 illustrates an exploded perspective view of a dryer according to an embodiment of the present invention.
Figure 2:
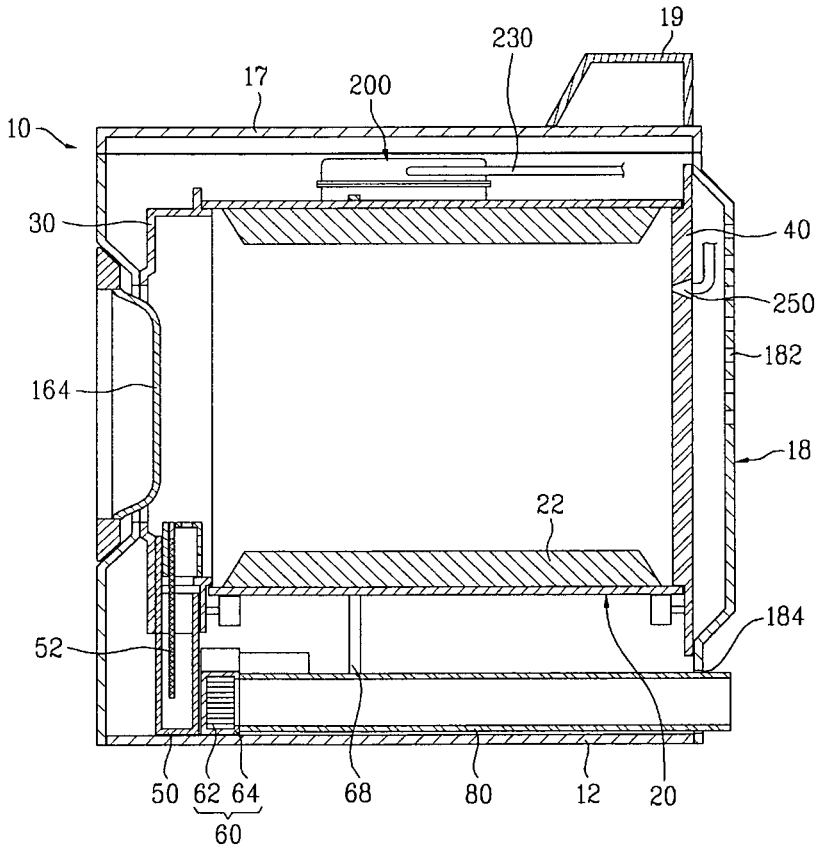
FIG. 2 illustrates a cross-sectional view of the dryer according to the embodiment of the present invention.

Hereinafter, a dryer according to an embodiment of the present invention will be described with reference to FIGS. 1 and 2. For convenience, a front-loading, electric, exhaust dryer is explained as an example, but the present invention is not limited thereto.

A rotatable drum 20, a motor 70 which drives the drum 20 and a belt 68 are installed inside a cabinet 10 forming an external appearance of the dryer. Further, an air supply unit is disposed in the cabinet 10 to supply hot air or cool air into the drum 20. In this case, articles to be dried are accommodated in the drum 20.

Herein, the drum is the laundry accommodating portion of the dryer which accommodates laundry or articles to be dried.

The air supply unit includes a heater 90 (hereinafter, simply referred to as a "hot air heater") which heats air to produce high-temperature air (hereinafter, referred to as "hot air") and a hot air supply duct 44 which supplies hot air produced in the hot air heater 90 to the drum 20, all of which are disposed at specific positions of the cabinet 10. Further, the dryer includes an exhaust duct 80 which discharges humid air that has been heat-exchanged with the articles to be dried in the drum 20, and a blower unit 60 which sucks the humid air. Of course, a condensation dryer may include a condensation duct and a condenser for condensing the humid air, which has been heat-exchanged with the articles to be dried, into water.

Meanwhile, a steam generating unit is disposed at a specific position of the cabinet 10. In this case, the steam generating unit generates steam to supply the steam into the drum. The steam generating unit includes a steam generator 200 which heats water to generate high-temperature steam.

For convenience, although an indirect drive type dryer which rotates the drum 20 using the motor 70 and the belt 68 is shown and described in this embodiment, the present invention is not limited thereto. That is, a direct drive type dryer which directly rotates the drum 20 by a motor directly connected to the rear surface of the drum 20 may be applied to the present invention.

The respective components are described in detail below.

The cabinet 10 forming an external appearance of the dryer includes a base 12 forming a bottom surface, a pair of side covers 14 vertically installed on the base 12, a front cover 16 and a rear cover 18 respectively installed on the front and rear surfaces of the side covers 14, and a top cover 17 positioned at an upper portion of the side covers 14. A control panel 19 having various control switches and the like is generally disposed on the top cover 17 or the front cover 16. A door 164 is installed on the front cover 16. The rear cover 18 includes a suction port 182 which introduces outside air and an exhaust hole 184 serving as a final passage to discharge air in the drum 20 to the outside.

An inner space of the drum 20 serves as a drying chamber to perform a drying operation, and the drum 20 has a lift 22 therein.

Meanwhile, a front supporter 30 and a rear supporter 40 are installed between the drum 20 and the cabinet 10 (the front cover 16 and the rear cover 18). The drum 20 is rotatably installed between the front supporter 30 and the rear supporter 40. Sealing members (not shown) are installed between the front supporter 30 and the drum 20 and between the rear supporter 40 and the drum 20, respectively, to prevent leakage. That is, the front supporter 30 and the rear supporter 40 close the front and rear surfaces of the drum 20 to form the drying chamber and serve to support a front end and a rear end of the drum 20.

An opening is formed on the front supporter 30 such that the drum 20 communicates with the outside of the dryer. The opening is selectively opened and closed by the door 164. Further, a lint duct 50 serving as a passage for discharging air of the drum 20 to the outside is connected to the front supporter 30, and a lint filter 52 is installed in the lint duct 50. The lint duct 50 is connected to one side of the blower unit 60, and the other side of the blower unit 60 is connected to the exhaust duct 80. The exhaust duct 80 communicates with the exhaust hole 184 disposed on the rear cover 18. Accordingly, when the blower unit 60 is operated, air in the drum 20 is discharged to the outside through the lint duct 50, the exhaust duct 80 and the exhaust hole 184. In this case, foreign matter such as nap is filtered by the lint filter 52. Generally, the blower unit 60 includes a blower 62 and a blower housing 64, and the blower 62 is connected to and driven by the motor 70 for driving the drum 20.

An opening 42 generally having a number of through holes is formed on the rear supporter 40. The opening 42 is connected to the hot air supply duct 44. The hot air supply duct 44 communicates with the drum 20 to serve as a passage for supplying hot air to the drum 20. Accordingly, the hot air heater 90 is installed at a specific position of the hot air supply duct 44.

Figure 3:
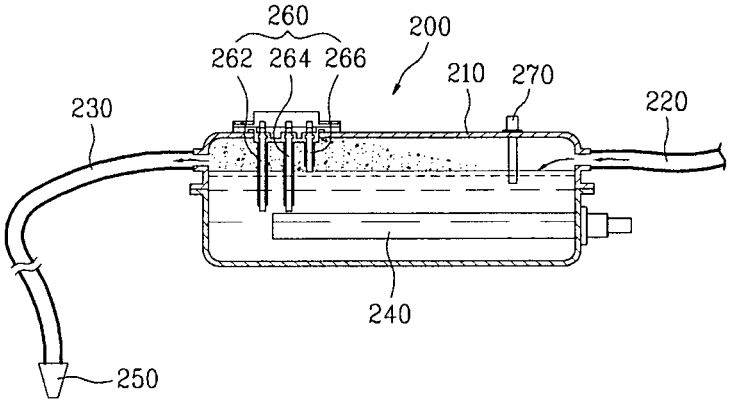
FIG. 3 illustrates a steam generator used in the dryer of FIG. 2.

Hereinafter, the steam generator 200 is described in detail below with reference to FIG. 3.

The steam generator 200 includes a water tank 210 for accommodating water therein, a heater 240 mounted in the water tank 210, a water level sensor 260 which measures a water level in the water tank 210, and a temperature sensor 270 which measures a temperature of water accommodated in the water tank 210.

The water level sensor 260 generally includes a common electrode 262, a low water level electrode 264 and a high water level electrode 266. The water level sensor 260 detects a high water level and a low water level according to whether the common electrode 262 is electrically connected to the high water level electrode 266 or whether the common electrode is electrically connected to the low water level electrode 264.

A water supply line 220, which is extended from a water accommodating portion to be described later to supply water, is connected to one side of the steam generator 200. A steam line 230 for discharging steam is connected to the other side of the steam generator 200. It is preferable that a nozzle 250 is installed at a leading end of the steam line 230 to increase a steam spraying efficiency.

Accordingly, according to the present invention, steam is supplied into the drum by the steam supply unit including the steam generator 200.

However, the steam generator 200 may have a different configuration. That is, the steam may be generated by heating water flowing in a pipe-shaped housing (not shown) instead of heating water accommodated in the water tank 210. For simplicity, the former refers to a container type steam generator and the latter refers to a pipe type steam generator.

Since the pipe type steam generator rapidly heats water to generate steam, it has a steam generation time shorter than that of the container type steam generator. However, in the pipe type steam generator, hot water instead of steam may be supplied into the drum. In comparison, the container type steam generator has an advantage of stably supplying steam into the drum.

In this case, the following effects can be obtained by using steam in the dryer.

Generally, the dryer performs a drying operation on the articles to be dried by hot air. As the drying operation proceeds, wrinkles or creases occur in the articles, and additional ironing is necessary after the drying operation is completed. However, the wrinkles or creases can be relieved or removed by supplying steam to the articles as the drying operation proceeds. The steam is supplied to the creases or wrinkles of the articles, and moisture of the articles is dried by hot air, thereby removing the creases. Thus, it is preferable to supply the steam to the articles after the drying operation proceeds to a certain extent.

Meanwhile, the steam has very fine particles, which are hot water particles of a few microns. Accordingly, the steam supplies moisture and high-temperature heat to the articles to be dried, thereby removing odor particles. Thus, it is possible to efficiently remove the odor by the dryer using steam.

That is, it is possible to efficiently remove water-soluble odor components from the articles to be dried by supplying moisture to the articles. Also, it is possible to efficiently remove fat-soluble or volatile odor components from the articles to be dried by the high-temperature heat. Accordingly, it is possible to very efficiently remove the odor by supplying the steam rather than by supplying only water to the articles to be dried.

Further, it is possible to supply a certain amount of moisture to the clothes through steam before the drying operation is completed. Of course, it is also possible to supply a certain amount of moisture to the clothes through steam after the drying operation is completed. The moisture is supplied all over the clothes through steam, thereby preventing displeasure of the user due to static electricity of the clothes when the user takes the clothes out of the drum.

In this case, the steam is a medium for supplying moisture and high-temperature heat to the articles to be dried. As described above, since the steam has very fine particles and a high temperature, the steam can efficiently infiltrate through the articles to be dried. Accordingly, the moisture can be uniformly absorbed into the entire articles to be dried. It is possible to efficiently prevent moisture from being excessively absorbed into only a specific portion. Consequently, it is possible to uniformly remove wrinkles, static electricity, and the odor from the entire articles to be dried.

Figure 4:
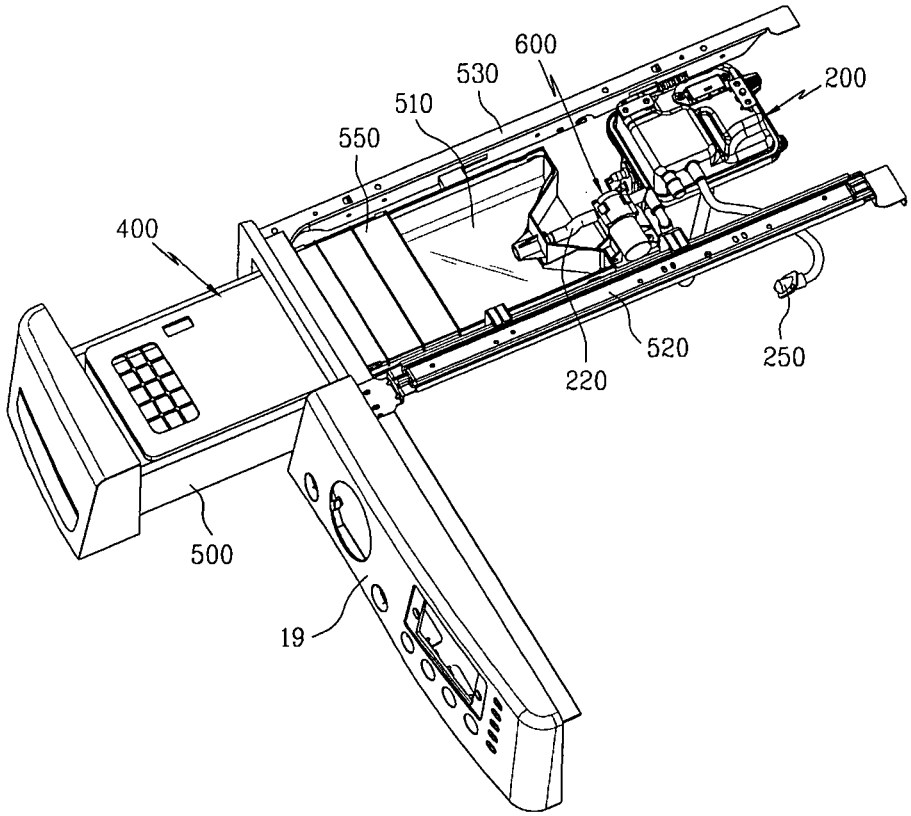
FIG. 4 illustrates a dryer according to another embodiment of the present invention.

FIG. 4 illustrates an embodiment in which the user directly supplies water to the steam generator 200 which is not connected to an external water supply source. In this case, the dryer using steam can be conveniently used in the environment lacking in facilities such as water supply equipment and drain equipment. Of course, water can be supplied into the steam generator through an external water supply as in a general laundry machine.

Hereinafter, the steam generator 200 according to the embodiment of the present invention and the structure of supplying water to the steam generator 200 will be described.

A drawer type container (hereinafter, referred to as a "drawer") 500 capable of being extracted and retracted is installed at a predetermined portion of the dryer according to the present invention. Preferably, a tank 400 is mounted in the drawer 500. In this case, the tank is a water accommodating portion for accommodating water, and the water accommodated in the water accommodating portion is supplied into the steam generator 200.

It is preferable to mount the tank 400 in the drawer 500 and to indirectly connect/disconnect the drawer 500 to/from the water supply line 220 by retracting/extracting the drawer 500, rather than to directly connect the tank 400 to the water supply line 220. As for the reason, the dryer uses a very small amount of water compared to the laundry machine, and the dryer may be used in the environment lacking in water supply equipment.

Further, the drawer 500 may be disposed on the front surface of the dryer, namely, the front surface of the cabinet of the dryer. Particularly, it is preferable that the drawer 500 is disposed on, for example, the control panel 19.

Specifically, a supporter 520 is installed at the rear of the control panel 19. That is, the supporter 520 is installed substantially parallel to a top frame 530. Preferably, a drawer guide 510 is installed on the supporter 520 and the top frame 530 to guide and support the drawer 500. More preferably, a top guide 550 is disposed at a portion of the top of the drawer guide 510.

In this case, the upper portion and one side surface (on the front surface side of the dryer) of the drawer guide 510 are open. The drawer 500 is extracted and retracted through the open portion.

Meanwhile, preferably, the tank 400 which supplies water to the steam generator 200 is configured to be attachable and detachable in this embodiment.

In case of using the attachable and detachable tank 400 as in this embodiment, the tank 400 is detached and supplied with water, and the tank 400 filled with water is connected to the water supply line 220 of the steam generator 200, which is very convenient.

Further, preferably, a pump 600 is disposed between the tank 400 and the steam generator 200. The pump 600 can rotate forward and backward and supply water to the steam generator 200. More preferably, the pump 600 collects residual water from the steam generator 200 as occasion demands.

Accordingly, the steam supply unit of the present invention includes the steam generator 200 which generates steam, the pump 600 which pumps water accommodated in the tank 400 to supply water to the steam generator, and the nozzle 250 which supplies the steam generated in the steam generator into the drum.

In this case, the water supply line 220 for supplying water is disposed between the tank 400 and the steam generator 200. The steam line 230 is disposed between the steam generator 200 and the nozzle 250. Further, the lines 220 and 230 may be configured as a pipe.

Further, although steam is supplied into the drum in the above embodiment, the present invention is not limited thereto.

For example, the steam generator 200 for generating steam may be omitted in the above embodiment. In this case, fine water particles may be supplied into the drum instead of the steam.

That is, when the water accommodated in the water accommodating portion 400 is pumped by the pump 600, a water pressure is generated. Accordingly, the water having a water pressure may be converted into fine water particles while passing through the nozzle 250 and, then, supplied into the drum. In this case, the nozzle 250 for supplying fine water particles may have a different shape from the above-mentioned steam nozzle. Of course, the water pressure may be a water pressure of the external water supply. That is, in a case where the external water supply is connected to the dryer, the pump 600 may be omitted. Also, in a case where the steam generator 200 is disposed in the dryer, the pump 600 may be omitted.

In this case, since the fine water particles are generated by spraying high-temperature water, the fine water particles do not have a high temperature. Further, the particles have a size of several tens of microns. Accordingly, compared to the steam, it is worrisome that the fine water particles may be supplied to only a specific portion without being uniformly supplied to the articles to be dried. Also, it is worrisome that the fine water particles may not infiltrate deeply into the articles to be dried.

In order to remove the worry, it is necessary to heat the fine water particles to a high temperature. That is, it is necessary to make the fine water particles similar to the above-mentioned steam to the maximum extent.

As described above, the air supply unit is disposed in the dryer to supply hot air or cool air into the drum. Accordingly, when the fine water particles are supplied into the drum, preferably, the air supply unit is operated and controlled to supply hot air into the drum. Accordingly, the fine water particles are heated and partially converted to vapor, thereby decreasing the size of the particles and increasing the temperature of the particles. Thus, the moisture can infiltrate uniformly and deeply into the articles to be dried. Further, preferably, a position of the nozzle for spraying the fine water particles is adjacent to a position of the opening 42 at which hot air is introduced into the drum in order to obtain an effective action between the fine water particles and the hot air.

That is, the spray nozzle 250 for supplying fine water particles into the drum may be disposed on the rear supporter 40 adjacent to the opening 42.

Of course, the nozzle may be positioned in the hot air supply duct 44. Accordingly, the fine water particles may be heated in the hot air supply duct and supplied into the drum together with hot air through the opening 42.

Hereinafter, the control panel 19 for providing an interface with the user will be described with reference to FIG. 5.

The control panel 19 includes a course selection part 610, a power button 620 and a start button 621. The user can select a desired operation course among a plurality of courses through the course selection part 610.

The course selection part 610 includes a steam course 613, a steam-available course 611 and a steam-free course 612. Each course may include a plurality of courses. In this case, the steam course 613 is a course which includes a steam process in which steam is supplied into the drum. The steam-available course 611 is a course which selectively includes the steam process. The steam-free course 612 is a course which excludes the steam process.

Accordingly, if a desired course is selected through the course selection part 610, the controller controls the operation of the dryer according to the selected course.

Further, the control panel 19 may include an option selection part 630 which allows the user to additionally select an option course including the steam process in the operation course.

Further, the control panel 19 includes a printed part 614 having various shapes, which includes letters printed on the respective buttons, letters printed around the course selection part 610 and the like. The user can perceive a course or an option to be inputted through the printed part. Further, as will be described later, the user can easily perceive whether each course includes the steam process or selectively includes the steam process, whether dryness is detected to perform an optimum drying operation or an additional function, or the like.

Hereinafter, a drying function and additional functions provided in the dryer according to the present invention that are selected and controlled through the control panel shown in FIG. 5 will be described in detail.

The user can select the steam-available course 611 through the course selection part 610. In this case, the steam-available course is a course which selectively includes the steam process. The user can select the steam process through the option selection part 630.

For example, the steam-available course 611 may include various courses according to the type of clothes having a low possibility of heat damage. The steam-available course 611 may include a general drying course, a course for drying cotton or a towel, and a course for jeans required to be dried for a long period of time.

Since the steam-available course 611 is a course for drying the clothes having a low possibility of heat damage, the steam-available course 611 includes a drying process in which hot air is supplied into the drum to dry target articles and a cooling process in which cool air is supplied into the drum to cool the target articles. In this case, since the inside of the drum and the articles have a high temperature when the course is completed, the cooling process prevents the user from being hurt due to the high temperature. However, if the temperature of hot air is lowered in the last period of the drying process, the cooling process may be omitted.

Meanwhile, if the steam-available course 611 and the option course 630 are selected, the controller may control the dryer to perform the option course in the drying process or the cooling process. Further, the controller may control the dryer to perform the option course after the steam-available course is completed.

For example, a case where the steam-available course 611 is a general drying course (NORMAL) and the option course 630 is a static electricity removal course 632 (STATIC CARE) is explained below. The static electricity removal course is represented by STEAM in FIG. 5. Thus, the course may be another option course as well as the static electricity removal course.

If only the steam-available course is selected, static electricity is generated in the dried articles after the course is completed, thereby causing displeasure to the user. Accordingly, the static electricity removal course may be selected to remove the static electricity.

In order to remove the static electricity, it is necessary to supply the steam to the articles such that the articles have a certain moisture content. Accordingly, it is preferable to carry out the steam process after the drying process is completed. Further, the steam process may be performed during the cooling process and may be performed after the cooling process is completed. That is, the articles dried through the drying process have a certain moisture content through the steam process during or after the cooling process, thereby minimizing displeasure of the user due to the static electricity.

In this case, it is preferable to control the amount of steam supplied to the articles to remove or reduce the static electricity. As for the reason, since an excessive amount of steam makes the articles too wet, it may be necessary to redry the articles. Thus, it is preferable to control the amount of steam such that the articles have a moisture content less than 5%.

A case where the steam-available course 611 is a cotton/towel course (COTTON/TOWEL) and the option course 630 is a wrinkle removal course 631 (WRINKLE CARE) is explained below.

In this case, the steam process may be performed in the last period of the drying process. That is, the articles are dried through the drying process and the steam process is performed to uniformly supply steam to the articles. Thereafter, the drying process continuously proceeds to remove the wrinkles. Of course, the drying process is completed and the steam process may be performed. In this case, after the steam process is completed, the drying process may be resumed.

Meanwhile, it is preferable to perform the drying process after the steam process in the wrinkle removal course 631. As for the reason, in order to remove the wrinkles, it is necessary to supply a larger amount of steam than the amount of steam supplied to the articles to remove the static electricity as described above. Accordingly, it is necessary to dry the articles through the drying process after the steam process. In this case, the wrinkle removal effect can be improved through hot air.

In this case, the option course 630 may be repeatedly selected. For example, either or both of the static electricity removal course 632 and the wrinkle removal course 631 may be selected. In this case, the steam process may be performed several times. Of course, the steam process is performed at a different time point to obtain each function.

Further, the option course 630 may be selected by pressing a button. That is, a specific option course may be selected by repeatedly pressing a single button, or respective buttons may be provided according to respective option courses. Accordingly, the option course may proceed during the steam-available course by pressing a specific button, or the option course may proceed after the steam-available course by pressing another specific button.

It is preferable to control the operation such that the steam-available course 611 is performed by varying the operation conditions of the drying process according to the dryness detected in the drying process, which is simply referred to as "SENSOR DRY." That is, the dryness is detected during the drying process to achieve the optimum drying effect. Thus, it is possible to prevent excessive drying or insufficient drying.

Although not shown in the drawings, the dryness may be detected by a humidity sensor provided on the door. The humidity sensor is an electrode sensor capable of detecting the dryness through a voltage or current value generated when the articles are in contact with the electrode sensor. Since the detection of the dryness using the electrode sensor is apparent to those skilled in the art, the detailed description thereof is omitted.

For example, in case where an expected time of the drying process is 50 minutes at the beginning, a remaining time of the drying process is reduced if the articles are more dried than expected as the drying process proceeds, and the remaining time is extended if the articles are less dried than expected. Further, in addition to the time of the drying process, the capacity of the heater for generating hot air may be changed. Of course, a preset temperature in the drum for determining whether hot air is supplied or not may be also changed.

Meanwhile, the amount of the articles, that is, a laundry amount, may be determined according to the dryness detected during the drying process. The present course is a course for drying wet clothes after a washing operation. Accordingly, if the laundry amount is large, the drying process would be performed for a long period of time. That is, as time goes by, the clothes are slowly dried if the laundry amount is large, and the clothes are quickly dried if the laundry amount is small. Accordingly, it is possible to determine the laundry amount using this fact.

The steam course 613 includes the drying process for supplying hot air into the drum to dry the articles and the steam process. That is, if the steam course 613 is selected, the drying process is automatically performed. In the present course, the operation is controlled through the steam process according to the preset program, thereby obtaining an optimum additional function in addition to a simple drying function. Accordingly, if the steam course 613 is selected, it is preferable that the option course cannot be selected. That is, it is preferable to inactivate the option selection part 630.

The steam course 613 may include an easy ironing course (EASY IRON). In this course, the steam process may be performed such that the articles have a moisture content of 5% to 6% after the drying process is completed. Accordingly, after the course is completed, the clothes contain moisture to facilitate ironing.

Further, the steam course 613 may include a refresh course or a steam fresh course (STEAM FRESH). The steam fresh course is characterized to be performed on dry articles. That is, the steam fresh course may be performed to easily remove the odor or dust from dry clothes. Accordingly, the drying process may be omitted in an initial period of the present course. However, a process for supplying hot air or cool air into the drum may be included in the present course to remove dust. Further, the steam process is performed in the present course, and high-temperature steam is supplied to the articles to efficiently remove wrinkles and the odor. Further, it is possible to provide well-dried clothes by reviving strands of clothes. In the present course, it is preferable to supply steam such that the articles have a moisture content equal to or larger than 6% to remove the odor and wrinkles. Accordingly, it is preferable that the drying process for drying the articles is performed after the steam process. As for the reason, an object of the present course is to process dry clothes such that the user can wear the clothes immediately. However, since the drying process is performed to remove a small amount of moisture, preferably, the drying process is controlled to be performed for only a short period of time.

As described above, the steam course has a basic object to process dry articles, not to completely dry the articles. Accordingly, in the steam course, it is preferable that the drying process is performed according to a program which is set in advance in an initial period of the operation or a preset program. That is, it is preferable to control the operation such that the drying process is performed without varying the preset operation conditions of the drying process. For example, since it is preferable that the steam fresh course is performed for a short period of time, it is not preferable that the time required for the course is variable. Further, detection of dryness may cause unnecessary energy consumption.

Hereinafter, the steam fresh course of the steam course 613 will be described in detail.

A main object of the steam fresh course is to remove the odor from the articles using steam. Of course, it is preferable to perform the present course on substantially dry articles as described above. Accordingly, a total operation time of the present course is shorter than another course, that is, a course performed on the articles to be dried.

Figure 6:
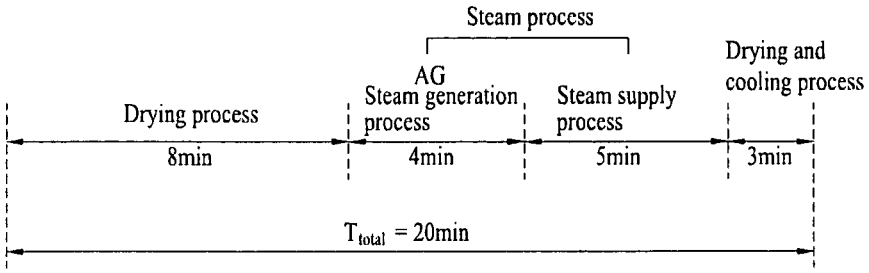
FIG. 6 is an operation flowchart of a steam fresh course according to an embodiment of the present invention.

FIG. 6 illustrates an operation flowchart of the steam fresh course according to the embodiment of the present invention.

A drying process, a steam process, and a drying and cooling process are sequentially performed for a total operation time of 20 minutes. In this case, the respective process times may be changed. For example, the drying process may be performed for 8 minutes, the steam process may be performed for 9 minutes, and the drying and cooling process may be performed for 3 minutes. Of course, an odor removal effect can be improved by increasing the total operation time of the present course and also increasing sub-processes in the present course. However, with regard to efficiency versus time and expectancy of the consumer, it is preferable that the total operation time of the present course is substantially 20 minutes or so.

The drying process functions to remove volatile odor particles and to facilitate the subsequent steam process by increasing the temperature of the inside of the drum and the articles to be dried. Further, the drying process functions to remove dust from the articles to be dried.

Further, the steam process functions to remove both volatile odor particles and water-soluble odor particles by providing high-temperature heat and moisture to the articles to be dried. In this case, the steam process may include a steam generation process in which the heater of the steam generator is driven to generate steam and a steam supply process. In the example of FIG. 6, the steam generation process is performed for 4 minutes, and the steam supply process is performed for 5 minutes.

The steam generator 200 is a container type steam generator in this example. In a pipe type steam generator, the steam generation process time may be reduced. In this case, substantially, the steam generation process time may be included in the steam process time. That is, in the pipe type steam generator, since a small amount of water is instantly heated to generate steam, if the heater of the steam generator is driven, the steam can be instantly supplied.

Thereafter, when the steam process is completed, the drying and cooling process may be performed to dry and cool the articles.

Figure 7:
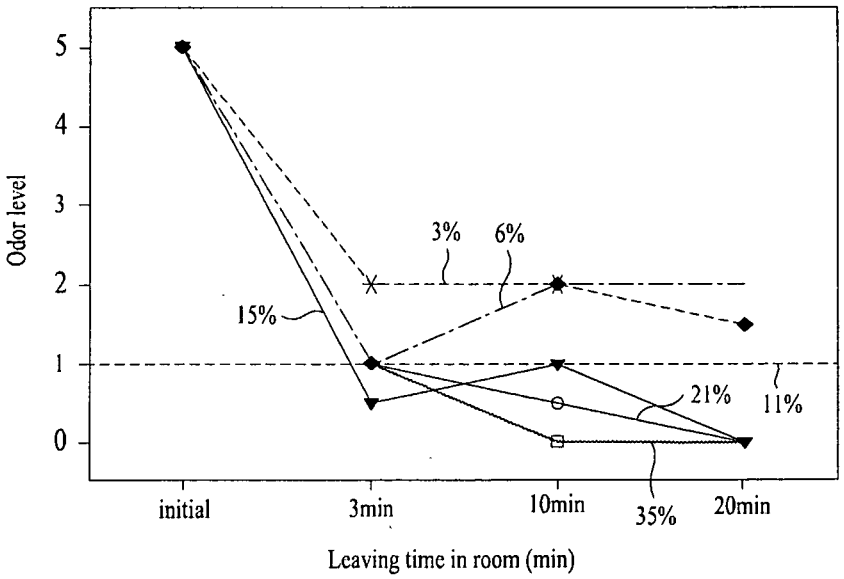
FIG. 7 shows a graph of odor removal characteristics in relation to the steam fresh course.

FIG. 7 is a graph of odor removal characteristics related to the steam fresh course.

As shown in FIG. 7, odor levels may include five odor levels. If an odor level before the course begins is a fifth level and a target level is a first level, the experiment results shown in FIG. 7 may be obtained according to the moisture content of the articles to be dried.

The course is performed on the articles having different moisture contents before the course begins. The articles are left for 3 minutes in the drum after the course is completed. In this case, if the moisture content is equal to or larger than 6%, the odor level can reach a first level that is a target level. However, if the moisture content is 3%, the odor level cannot reach a target level. Accordingly, it can be seen that steam is supplied to the articles to be dried such that the articles have a moisture content of 6% or more in order to efficiently remove the odor.

In this embodiment, with regard to the capacity of the steam generator, the steam is supplied for 5 minutes such that the articles have a moisture content of 6%.

However, if the moisture content is 6%, as the articles are left for a while in the drum after the course is completed, the odor may occur again. That is, if the leaving time is 10 minutes, the odor level is increased to a second level.

In many cases, the user leaves the articles in the drum without immediately taking the articles out after the course is completed. Accordingly, the user may feel that the odor is not removed even though the course is performed, thereby reducing reliability of the dryer according to the present invention in addition to the present course.

Further, the odor recurs as the heat and humidity in the drum activate the odor components. It is necessary to more efficiently remove the odor components in order to prevent the recurrence of the odor.

From the results shown in FIG. 7, if the moisture content is equal to or larger than 11%, it can be seen that the odor level does not exceed a first level even though the articles are left in the drum. Accordingly, steam can be supplied into the drum such that the articles have a moisture content of 11% or more, regardless of a laundry amount in the drum. However, it may cause a problem of excessively increasing energy consumption versus effect. Thus, it is preferable that an adequate amount or a recommended amount of the articles (for example, 3 shirts) have a moisture content of 11%.

Meanwhile, as shown in FIG. 7, if the moisture content further increases, it is possible to prevent the odor from recurring as the articles are left. It means that effects of removing the odor and preventing the recurrence of the odor depend on the moisture content of the articles due to steam rather than the drying process using hot air.

Figure 8:
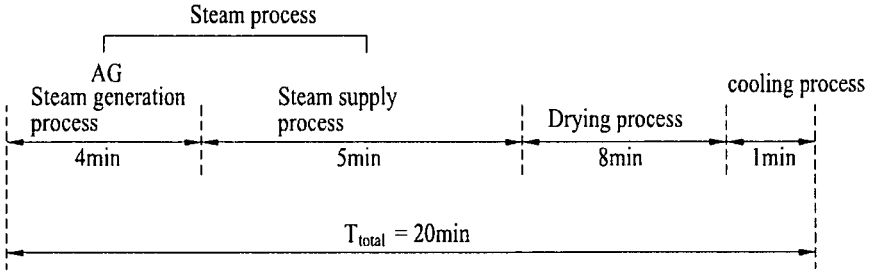
FIG. 8 is an operation flowchart of a steam fresh course according to another embodiment of the present invention.

Thus, another embodiment of the present course for removing the odor and preventing the recurrence of the odor will be described in detail with reference to FIG. 8.

As described above, also in this embodiment, it is preferable that a total operation time is about 20 minutes.

In this embodiment, since the steam process is more important than the drying process to remove the odor and prevent the recurrence of the odor, the steam process time is further extended. Further, the drying process is performed after the steam process in order to sufficiently dry the articles.

First, the steam process may be performed for 11 minutes. In the steam process, the steam generation process may be performed for 4 minutes, and the steam supply process may be performed for 7 minutes. In this case, in the steam supply process performed for 7 minutes, the steam is supplied such that the moisture content is larger than 6%, preferably, 11% or more, as shown in FIG. 7.

Meanwhile, for example, on the assumption that a constant amount of steam is supplied in the drum, as the amount of the articles to be dried accommodated in the drum increases, the moisture content becomes small. In this case, the moisture content is calculated on the basis of a minimum amount of the articles at which the dryer can detect that the articles are accommodated in the drum. Accordingly, in a case where a target moisture content is 11%, if steam is supplied to the minimum amount of the articles for 7 minutes, the moisture content necessarily becomes larger than 11%. However, as shown in FIG. 7, this case is preferable since it is possible to more efficiently remove the odor and prevent the recurrence of the odor as the moisture content becomes larger than 11%. Further, since the steam is not indefinitely supplied, the moisture content does not exceed a certain moisture content. Moreover, since the laundry amount is small and an absolute amount of moisture to be removed is constant, the articles can be sufficiently dried during the drying process.

On the other hand, if a maximum amount of the articles are accommodated in the drum, in the same way, the absolute amount of steam supplied into the drum may be the same as in the above case. That is, for example, since the steam is supplied for 7 minutes, the amount of steam is equal to the amount of steam supplied to the minimum amount of the articles. Accordingly, in this case, although the moisture content becomes smaller than that of the minimum amount of the articles, the moisture content can reach at least 6% preferably, 11%.

That is, in this embodiment, the minimum moisture content is 6% or more, preferably, 11% or more, in the maximum laundry amount. In this case, the amount of steam is constant by controlling the steam supply process time regardless of the laundry amount. Accordingly, since the amount of moisture to be removed is the same regardless of the laundry amount, the articles can be sufficiently dried by performing the subsequent drying process for a specific period of time.

Thus, according to the embodiments of the present invention, it is possible to efficiently remove the odor and prevent the recurrence of the odor regardless of the laundry amount without varying the total operation time. Since the articles can be sufficiently dried after the supply of steam, it is possible to satisfactorily remove the moisture inside the drum and also possible to reduce the temperature in the drum by the cooling process.

However, in a case where the moisture content is 11% in the maximum laundry amount, the steam is excessively supplied in the minimum laundry amount, thereby causing waste of energy. Further, since it preferable that the total operation time is preset regardless of the laundry amount in the present course, the moisture content of 11% is preferable on the basis of an adequate amount or a recommended amount of the articles (for example, 3 shirts). Accordingly, it is possible to achieve an optimum effect and energy reduction in the commonly-used laundry amount. Even in the maximum laundry amount, since the moisture content can reach at least 6%, it is possible to prevent the recurrence of the odor to the maximum extent.

Hereinafter, the steam-free course 612 is explained.

The steam-free course 612 is a course which does not include the steam process and does not allow selection of the steam process. That is, the steam-free course 612 is a course for delicate clothes having a possibility of heat damage. In the same way, if the steam-free course is selected, preferably, the controller controls the dryer that the user cannot select the option course including the steam process.

Figure 5:
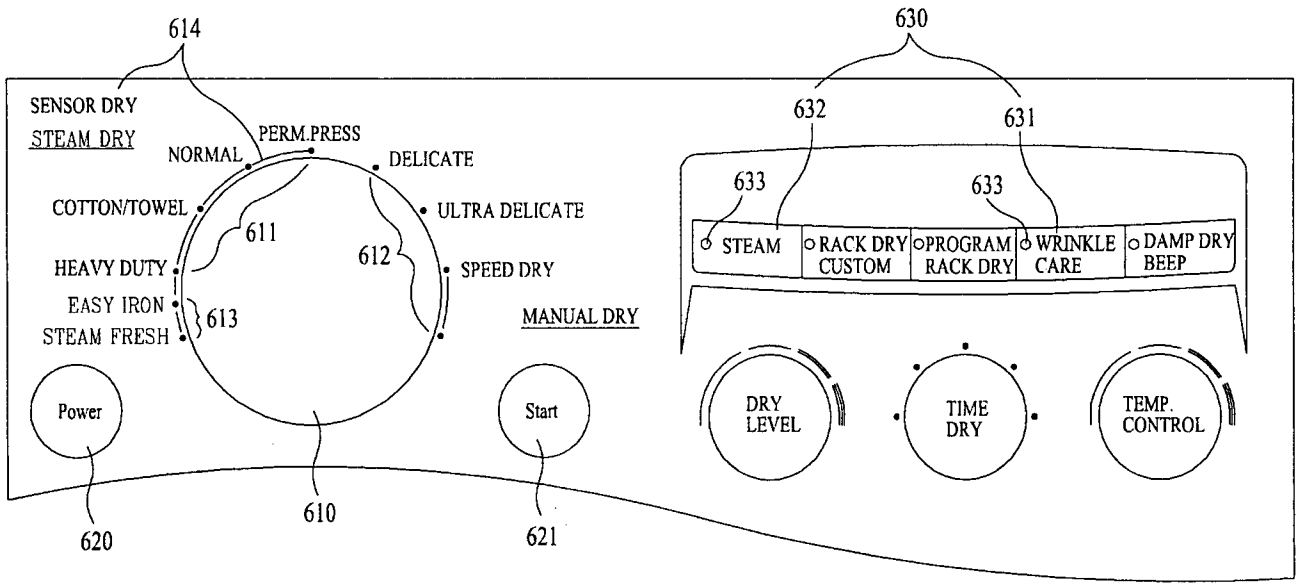
FIG. 5 illustrates a control panel of the dryer of FIG. 1.

As shown in FIG. 5, the control panel 19 of the dryer according to the present invention may include the printed part 614 formed in various shapes.

In a case where the course selection part 610 is formed in a rotary knob shape, the user can select a desired course by rotating the rotary knob. As described above, the dryer according to the present invention includes various courses according to whether the steam process is included or available.

For example, the courses in which the steam process is included or available are disposed on the left of the course selection part 610. The courses in which the steam process is excluded may be disposed on the right of the course selection part 610. Letters "STEAM DRY" may be printed on the left of the course selection part to allow the user to easily perceive the fact. Further, the letters "STEAM DRY" may be printed in a specific color, and the corresponding courses may be displayed by printing an arc in the same color as the specific color as shown in FIG. 5. Accordingly, when the user selects the course printed in a specific color or represented with an arc, the user can easily perceive whether the steam is used or available in the course.

Meanwhile, it is preferable to surely distinguish the steam course from the steam-available course. Accordingly, for this, the steam-available course and the steam course may have letters printed in different colors. For example, the steam-available course may have the letters printed in black and the steam course may have the letters printed in red. Further, the letters "STEAM DRY" may be printed and underlined in red. Accordingly, the user can easily distinguish the steam course from the steam-available course through the above-described printed part. In other words, the user can clearly perceive that the courses having the red arc and the black letters are included in the steam-available course and the courses having the red arc and the red letters are included in the steam course.

Further, there are a sensing and drying course in which the dryness is detected to vary the operation conditions during the course as described above, and a non-sensing and drying course in which the dryness is not detected. Accordingly, as shown in FIG. 5, sensing and drying courses can be displayed with letters "SENSOR DRY" and printed with letters in the same color as the letters "SENSOR DRY." That is, the letters "SENSOR DRY" may be printed in black and the respective sensing and drying courses may be printed with letters in black. Accordingly, the user can easily perceive that the courses having black letters are sensing and drying courses.

Thus, the user can select various types of operation courses and also clearly perceive the features of the respective operation courses through the printed part 614 having various shapes capable of being visually distinguished. Further, the user can clearly perceive whether the option course 630 related to the steam process can be selected through the printed part 614. Thus, the user can easily use the dryer and it is very easy to utilize a drying function and various additional functions.

Meanwhile, although not shown in FIG. 5, a button which allows the user to select the amount of the articles may be provided. Further, a button which allows the user to select the supply amount of steam may be provided. Both or either of the buttons may be provided. When either of the buttons is provided, if the user selects a large amount of the articles, the controller may increase the supply amount of steam in the steam process in response thereto.

Further, LEDs 633 may be provided on the option selection part 630. For example, the LEDs may be provided on the option course buttons 631 and 632, respectively. In this case, the LEDs in a twinkling state may be lighted when the buttons are selected. On the other hand, the LEDs in a lighted state may twinkle when the buttons are selected. Of course, after the LEDs are lighted, the LEDs may be turned off when they are selected. That is, the LEDs may be configured to have different states before and after the selection. Accordingly, preferably, the states of the LEDs may be visually displayed for the user.

In this case, as described above, the option course buttons 631 and 632 can be selected when the steam-available course 611 is selected. Thus, if the steam-available course is selected, it is preferable that the LEDs are lighted or twinkling to notify the user that the option course can be selected. Of course, when the steam-free course is selected, it is preferable that the LEDs are turned off to notify the user that the option course cannot be selected.

The present invention can be applied to a washing and drying machine (so-called combo) which performs both washing and drying operations in addition to a typical dryer.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dryer comprising:

a laundry accommodating portion adapted to accommodate articles to be dried, a steam generating unit generating steam to supply into the laundry accommodating portion;

a control panel adapted to provide an interface with a user, and a controller, wherein the control panel includes a course selection part which allows a user to select a specific course as an operation course, which includes a steam process for supplying steam to the laundry accommodating portion, and wherein the controller controls an operation of the dryer to perform the selected operation course, and during the steam process the controller operates the steam generating unit to supply a constant amount of steam into the laundry accommodating portion for a fixed time, resulting in a fixed amount of steam supplied, regardless of the amount of the article accommodated in the laundry accommodating portion such that the dried articles have a moisture content equal to or larger than 6%.

2. The dryer according to claim 1, wherein the controller controls the steam generating unit to perform the steam process such that the dried articles have the moisture content equal to or larger than 11% in the specific course.

3. The dryer according to claim 2, the specific course further includes:

a drying process in which hot air is supplied into the laundry accommodating portion to dry the articles; and a cooling process in which cool air is supplied into the laundry accommodating portion to cool the articles.

4. The dryer according to claim 3, wherein the steam process, the drying process and the cooling process are sequentially performed in the specific course.

5. The dryer according to claim 3, wherein a total operation time of the specific course is preset regardless of an amount of the articles to be dried accommodated in the laundry accommodating portion.

6. The dryer according to claim 5, wherein operation times of sub-processes included in the specific course are preset regardless of the amount of the articles to be dried accommodated in the laundry accommodating portion.

7. A dryer comprising:

a laundry accommodating portion adapted to accommodate articles to be dried;

a control panel adapted to provide an interface with a user; and a controller, wherein the control panel includes a course selection part which allows a user to select a specific course as an operation course, which includes a steam process for supplying fine water particles and hot air to the laundry accommodating portion, and wherein the controller controls an operation of the dryer to perform the selected operation course, and during the steam process the controller supplies a constant amount of fine water particles and hot air for a fixed time, resulting in a fixed amount of fine water particles and hot air, regardless of an amount of the article accommodated in the laundry accommodating portion such that the dried articles have a moisture content equal to or larger than 6%.

8. A dryer comprising:

a laundry accommodating portion adapted to accommodate articles to be dried;

a steam generating unit generating steam to supply into the laundry accommodating portion;

a control panel adapted to provide an interface with a user; and a controller, wherein the control panel includes:

a course selection part which allows a user to select an operation course among a steam-available course which selectively includes a steam process for supplying steam to the laundry accommodating portion, a steam course which includes the steam process, and a steam-free course which excludes the steam process;

an option selection part which allows the user to additionally select an option course including the steam process in the operation course; and a printed part provided to visually distinguish the steam-available course, the steam course and the steam-free course from each other, wherein the controller controls an operation of the dryer such that the selected operation course and option course are performed sequentially or simultaneously, and during the steam process the controller operates the steam generating unit to supply a constant amount of steam into the laundry accommodating portion for a fixed time, resulting in a fixed amount of steam supplied, regardless of the amount of the article accommodated in the laundry accommodating portion such that the dried articles have a moisture content equal to or larger than 6%.

9. The dryer according to claim 8, wherein the steam course further includes:

a drying process in which hot air is supplied into the laundry accommodating portion to dry the articles; and a cooling process in which cool air is supplied into the laundry accommodating portion to cool the articles, wherein the steam process, the drying process and the cooling process are performed to remove an odor from the articles.

10. A dryer comprising:

a laundry accommodating portion adapted to accommodate articles to be dried;

a control panel adapted to provide an interface with a user; and a controller, wherein the control panel includes:

a course selection part which allows a user to select an operation course among a steam-available course which selectively includes a steam process for supplying fine water particles and hot air to the laundry accommodating portion, a steam course which includes the steam process, and a steam-free course which excludes the steam process;

an option selection part which allows the user to additionally select an option course including the steam process in the operation course; and a printed part provided to visually distinguish the steam-available course, the steam course and the steam-free course from each other, wherein the controller controls an operation of the dryer such that the selected operation course and option course are performed sequentially or simultaneously, and during the steam process the controller supplies a constant amount of fine water particles and hot air for a fixed time, resulting in a fixed amount of fine water particles and hot air, regardless of an amount of the article accommodated in the laundry accommodating portion such that the dried articles have a moisture content equal to or larger than 6%.

* * * * *